US006110054A

United States Patent [19]

Rodarte

[11] Patent Number: 6,110,054

[45] Date of Patent: Aug. 29, 2000

[54] GOLF CLUB GRIP AND SWING STABILIZER

[76] Inventor: Michael R. Rodarte, 12371 Nutwood St., Garden Grove, Calif. 92640

[21] Appl. No.: 09/177,465

[22] Filed: Oct. 22, 1998

[51] Int. Cl.[7] ..... A63B 53/14

[52] U.S. Cl. ..... 473/203; 473/300; 473/276

[58] Field of Search ..... 473/203, 212–214, 473/276, 300–303, 549–552, 568, 316–323

[56] References Cited

U.S. PATENT DOCUMENTS

| | | | |
|---|---|---|---|
| 2,046,191 | 6/1936 | Smith | 473/203 |
| 3,111,322 | 11/1963 | English | 473/203 |
| 4,183,528 | 1/1980 | An | 473/526 |
| 4,836,544 | 6/1989 | Lai | 473/551 |
| 5,248,146 | 9/1993 | Viets | 473/206 |
| 5,259,621 | 11/1993 | Keefer | 473/212 |
| 5,772,523 | 6/1998 | Sheftic | 473/227 |
| 5,795,241 | 8/1998 | Peshek | 473/300 |
| 5,904,624 | 5/1999 | Martinez | 273/DIG. 30 |

*Primary Examiner*—Jeanette Chapman
*Assistant Examiner*—Stephen L Blau
*Attorney, Agent, or Firm*—Richard E. Bee

[57] ABSTRACT

A golf club grip assembly is provided for stabilizing and improving the swinging of a golf club. This grip assembly includes a pistol grip body adapted to be affixed to the upper end of a golf club shaft for grasping by the dominant hand of a golf player. This grip assembly further includes a forearm stabilizer blade affixed to the pistol grip body and extending outwardly from a rearward end of the pistol grip body for engaging the dominant forearm of a golf player.

16 Claims, 3 Drawing Sheets

GOLF CLUB GRIP AND SWING STABILIZER

TECHNICAL FIELD

This invention relates to golf clubs and particularly to golf club grip constructions and golf club grip attachments for improving the performance of golf players.

BACKGROUND OF THE INVENTION

There are many issued United States patents which describe various and sundry golf club constructions, attachments and devices which are intended either to cause or to train a in golfer to have a better swinging motion when hitting a golf ball.

One group of such patents relates to modified forms of construction for the handle portion or grip portion of a golf club. Representative patents in this group are: U.S. Pat. No. 3,574,349 issued to Norbert Kropp on Apr. 13, 1971; U.S. Pat. No. 4,163,554 issued to Floyd Bernhardt on Aug. 7, 1979; U.S. Pat. No. 4,625,965 issued to Fagan Mullins on Dec. 2, 1986; and U.S. Pat. No. 5,746,661 issued to James Murphy on May 5, 1998.

Another group of golf club patents relates to grip handle extensions which extend beyond the conventional grip handle and engage some portion of the golf player's body, other than his hands, for swing control purposes. Typical patents in this second group are: U.S. Pat. No. 5,209,474 issued to Paul Voyer on May 11, 1993; U.S. Pat. No. 5,465,971 issued to Edward Tischler on Nov. 14, 1995; and U.S. Pat. No. 5,772,523 issued to Ted Sheftic on Jun. 30, 1998.

The Voyer patent describes the use of an extra long shaft for a putter, which shaft extends nearly to the golfer's shoulder with an intermediate portion of the shaft resting in the crook of the golfer's leading arm. This arrangement is said to prevent flexing and bending of the wrists and leading arm and thereby providing improved putting consistency.

The Tischler patent describes the use of an elongated rod that is attached to the top end of a putter handle and extends upwardly to a crutch arm which fits under the rearward armpit of the golfer. This arrangement seeks to constrain the movement of the golfer's arms to a desired pattern.

The Sheftic patent describes the use of a relatively short, angularly extending arm which is attached to the top end of a golf club handle. This arm contacts the body of the golfer in the vicinity of the golfer's leading hip if the golfer fails to pivot or maintain a solid leading arm as he strikes a golf ball.

While these and the many other patented golf playing improvement devices may work to some degree, few of them have gained much popularity with the golfing community. Some of them are awkward to use. Others are cumbersome to carry around the golf course. And a goodly number of them have an unsightly or gimmicky appearance which would be likely to give rise to adverse comments from fellow golfers.

SUMMARY OF THE INVENTION

The present invention provides an easy to use and reliable golf club grip assembly for stabilizing and improving the swinging of a golf club. Furthermore, this improved grip assembly has an acceptable appearance factor and does not present any problems with carrying the golf club in a conventional golf bag.

The new and improved golf club grip assembly of the present invention includes a pistol grip body which is affixed to the upper end of a golf club shaft in place of the conventional grip. This pistol grip body has well-defined finger supports which ensure a consistent gripping of the golf club, such gripping occurring in a natural and comfortable manner.

The new and improved golf club grip assembly of the present invention further includes a forearm stabilizer member which is affixed to the pistol grip body and extends outwardly from a rearward end of the pistol grip body for engaging the forearm of the golf player. This stabilizer member ensures a straight sweeping follow-through motion of the arm when contacting the golf ball.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE ILLUSTRATED EMBODIMENT

Figure 1:
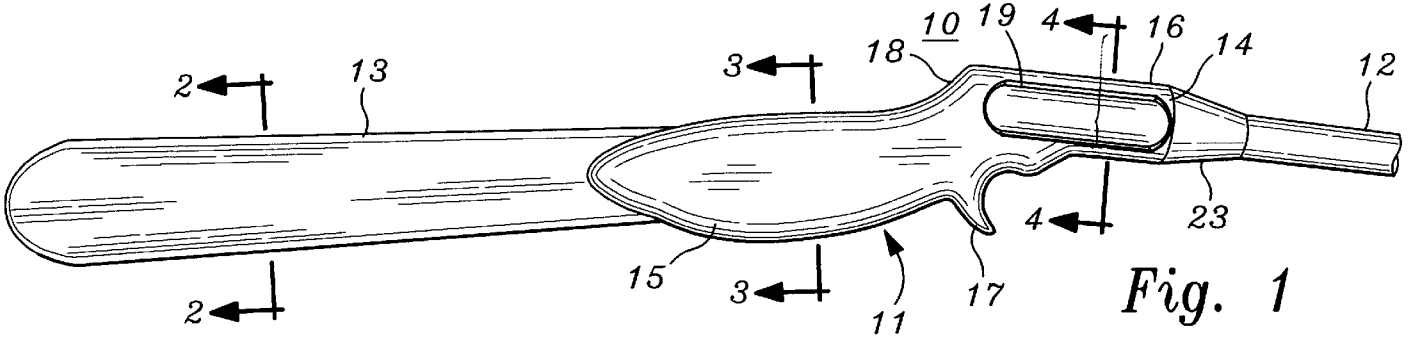
FIG. 1 is a right side elevational view of a representative embodiment of a golf club grip assembly constructed in accordance with the present invention.
Figure 5:
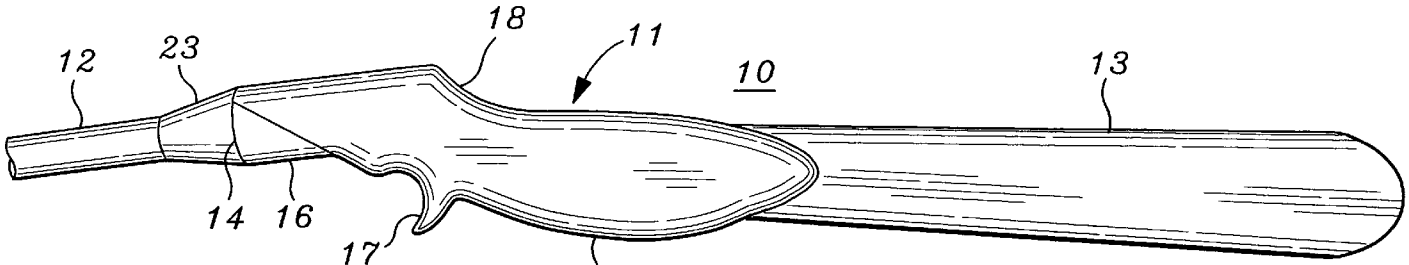
FIG. 5 is a left side elevational view of the golf club grip assembly of FIG. 1.

Referring to FIGS. 1 and 5, there are shown right side and left side views of a representative embodiment of a golf club grip assembly 10 constructed in accordance with the present invention. This illustrated embodiment is designed for use by a right-handed golf player. As will be discussed, a corresponding embodiment can be manufactured for left-handed golf players. As used herein, the term "dominant hand" means the right hand of a right-handed player and the left hand of a left-handed player. In a similar manner, the term "dominant forearm" refers to the right forearm of a right-handed player and the left forearm of a left-handed player.

The golf club grip assembly 10 includes a pistol grip body 11 adapted to be affixed to or mounted on the upper end of a golf club shaft 12 in place of the conventional golf club grip. This pistol grip body 11 is designed for grasping by the dominant hand of a golf player which, in the illustrated embodiment, is the right hand. The golf club grip assembly 10 further includes a forearm stabilizer member 13 affixed to the pistol grip body 11 and to extending outwardly from a rearward end of the pistol grip body 11 for engaging the right (dominant) forearm of the golf player.

Figure 2:
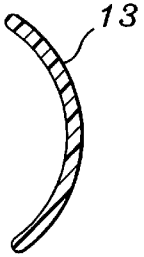
FIG. 2 is a cross-sectional view taken along Section Line 2—2 of FIG. 1.

The forearm stabilizer member 13 is an elongated blade-like member. As indicated in the cross-sectional view of FIG. 2, this stabilizer member or blade 13 is relatively thin in nature and is curved or concave in shape. The curvature of the stabilizer blade 13 is made to correspond approximately to the curvature of the golf player's dominant forearm. In use, the stabilizer blade 13 is intended to rest firmly against the player's dominant forearm, with the curvature of the blade matching the curvature of the forearm. A typical length for the stabilizer blade 13 is approximately eight inches. Different models having different lengths and different curvatures for the stabilizer blade 13 can be provided to provide a comfortable fit for golf players of different sizes.

Figure 3:
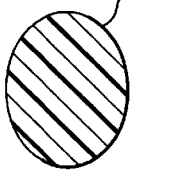
FIG. 3 is a cross-sectional view taken along Section Line 3—3 of FIG. 1.

The pistol grip body 11 is an elongated body having a forward end 14 which is adapted to be connected to the upper end of the golf club shaft 12. The elongated pistol grip body 11 has a thick rearward hand grip portion 15 and a forward barrel-like portion 16. The thick, bulbous nature of the rearward hand grip portion 15 is indicated in the cross-sectional view of FIG. 3.

Figure 4:
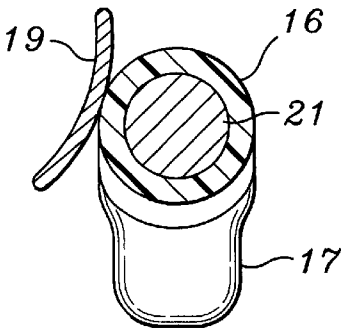
FIG. 4 is a cross-sectional view taken along Section Line 4—4 of FIG. 1.

The pistol grip body 11 further includes a curved downwardly-extending trigger-shaped portion 17 located at the rearward end of the barrel-like portion 16 on the underside of the barrel-like portion 16. This trigger-shaped portion 17 is intended for gripping by the middle finger of the golf player's dominant hand. A front view of the trigger-shaped portion 17 is shown in the cross-sectional view of FIG. 4.

The upper side juncture of the hand grip portion 15 and the barrel-like portion 16 is shaped to provide a curved thumb rest 18 for receiving the thumb of the golf player's dominant hand.

The pistol grip body 11 further includes a curved elongated finger support 19 which is located on and affixed to the right side of the barrel-like portion 16. This finger support 19 extends in the same direction as the barrel-like portion 16 and is intended for supporting in an extended manner the index finger of the golf player's right hand. When positioned in the finger support 19, the index finger extends in the direction of the golf club shaft 12. The curved nature of the finger support 19 is shown in the cross-sectional view of FIG. 4.

Figure 6:
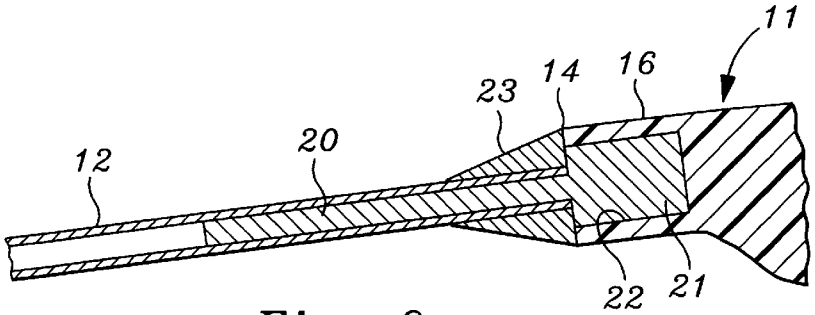
FIG. 6 is an elevational cross-section of the forward end of the grip assembly shown in FIG. 5.

As shown in the cross-sectional view of FIG. 6, the pistol grip body 11 also includes a connector rod 20 which extends from the forward end 14 of the pistol grip body 11 for insertion into the upper end of the golf club shaft 12. Connector rod 20 is provided with an enlarged cylindrical mounting head 21 which is mounted in a matching and snug-fitting cylindrical passageway 22 which is formed in the barrel-like portion 16. Mounting head 21 is permanently secured within the passageway 22. For the case where the pistol grip body 11 is made of plastic material, the mounting head 21 may be encased within the plastic material when the pistol grip body is molded.

A short tapered or conical sleeve 23 is mounted on the golf club shaft 12 at the upper end of the shaft 12 and is attached to both the golf club shaft 12 and the forward end 14 of the pistol grip body 11 by an appropriate adhesive material. This sleeve 23 provides a pleasing appearance to and gives added strength to the connection of the golf club shaft 12 to the pistol grip body 11.

Figure 7:
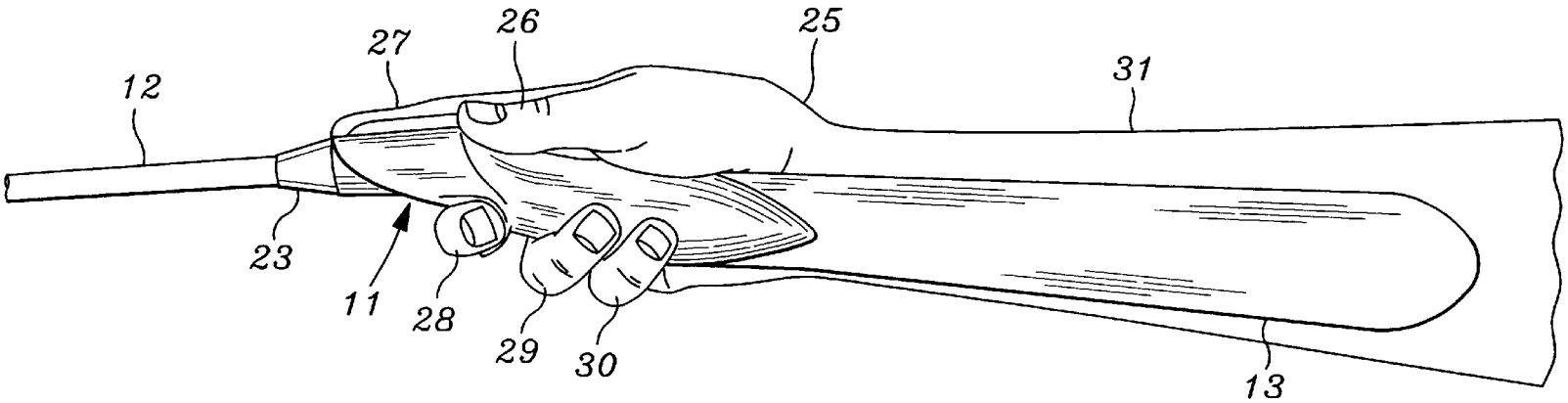
FIG. 7 is a left side elevational view showing the gripping of the grip assembly by the right hand of a golf player.

FIG. 7 shows how the golf club is held by the right hand 25 of a right-handed golf player when he is in the process of hitting a golf ball. The pistol grip body 11 is grasped by the right hand 25 by placing the thumb 26 on the thumb rest 18, the index finger 27 on the index finger support 19 in an extended manner, the middle finger 28 around the trigger-shaped finger support 17, and the ring and little fingers 29 and 30 around the underside of the rearward end of the pistol grip body 11. The forearm stabilizer blade 13 is placed along and pressed against the inner side of the right forearm 31 of the golf player.

Figure 8:
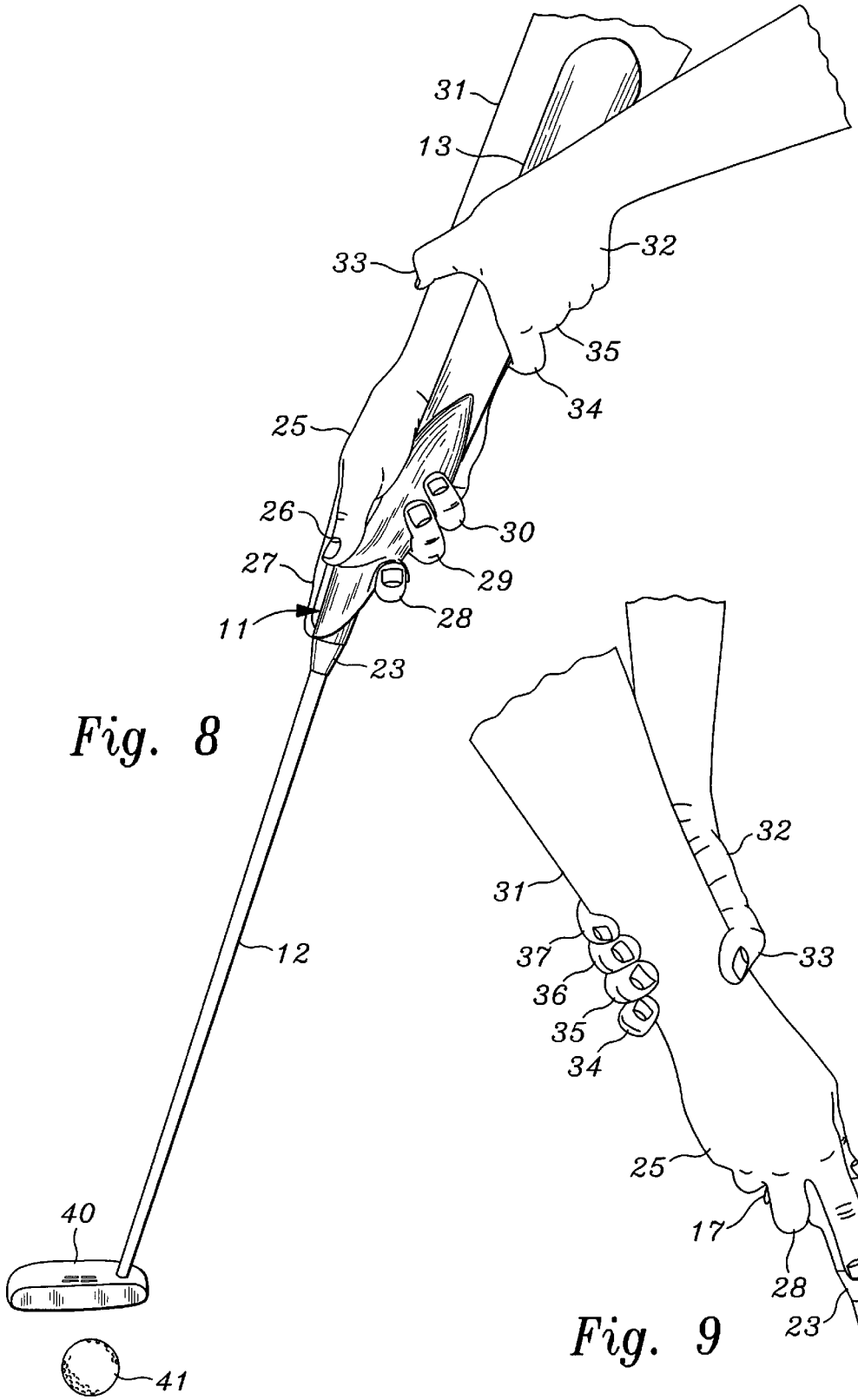
FIG. 8 is a perspective view showing a golf club with the grip assembly of FIGS. 1–6 being held by a golf player in a position to strike a golf ball.
Figure 9:
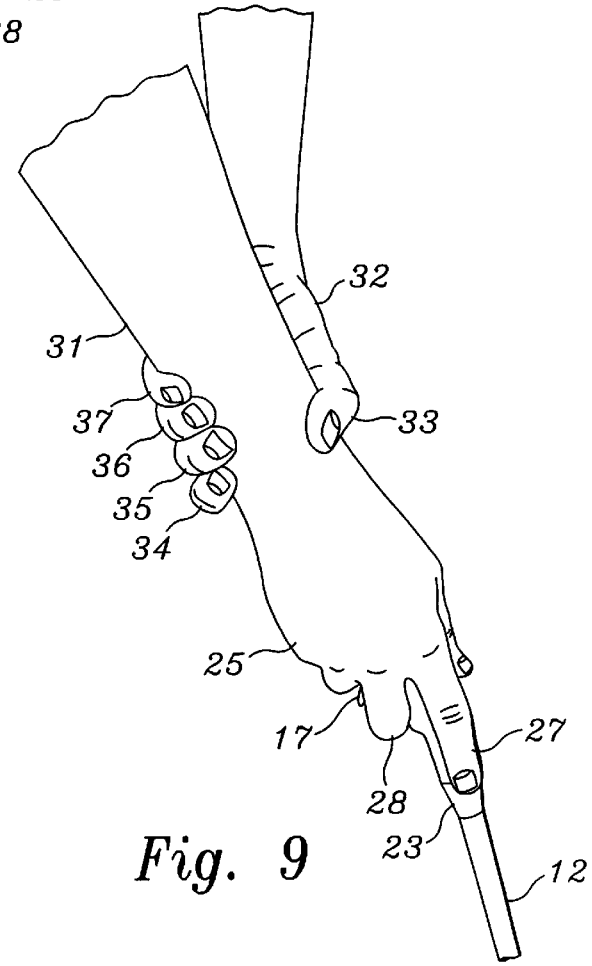
FIG. 9 is a perspective view taken from the side opposite the one shown in FIG. 8.

FIG. 8 shows the preferred placement of the left hand 32 of the golf player. The left thumb 33 is placed over the right forearm 31 above the right wrist, preferably about half way up the forearm stabilizer blade 13. The left fingers 34–37 are placed under and part way around the right forearm 31. The grip of the left hand 32 is tightened so as to press the forearm stabilizer blade 13 firmly against the inner side of the right forearm 31 of the golf player. A view of the FIG. 8 hand grips from the opposite side is shown in FIG. 9.

As seen in FIG. 8, the lower end of the golf club shaft 12 is attached to a club head 40 which is used for striking or hitting a golf ball 41. For sake of an example, the club head 40 is shown as being a putter head of the type used for putting the ball 41 when on a green. When putting the ball 41, the golf club and arms are moved with a sweeping follow-through motion in the manner of a pendulum.

The golf club grip assembly 10 can be constructed using various metals, wood, rigid plastics, fiberglass, and the like. For a representative embodiment, the pistol grip body 11 is molded using a plastic material which becomes rigid as it hardens. The connector rod 20 and mounting head 21 are made of steel and the mounting head 21 is placed in the mold so that it becomes encased in the plastic material when it is injected into the mold. The forearm stabilizer blade 13 is made of rigid plastic material and may be molded separately, in which case, it is thereafter glued into a mating slot formed in the rearward end of the pistol grip body 11. The index finger support 19 may be made of metal and is attached to the side of pistol grip body 11 by a strong adhesive material. For a representative embodiment, the exposed portion of the stabilizer blade 13 is approximately eight inches in length and the overall length of the pistol grip body 11 is approximately 7.5 inches.

A different and interesting way of fabricating the grip assembly 10 is to cast the entire grip assembly as a single piece, using a strong, light-weight metal as the casting material. With the exception of the connector rod, the molded grip assembly 10 is thereafter coated with a layer of rubber or rubber-like material.

The illustrated embodiment is made for use by a right-handed golf player. Two major changes are required to make a corresponding golf club grip assembly for left-handed golf players. The curvature of the forearm stabilizer blade 13 would be reversed so as to mate with the curvature of the inner side of the left forearm. Also, the elongated index finger support 19 would be relocated to the left side of the barrel-like portion 16 for supporting the index finger of the left hand in an extended position.

A golf club grip assembly constructed in accordance with the present invention provides the golf player with a steady and consistent pendulum motion when hitting a golf ball. This produces straighter hits and increased accuracy. The grip assembly of this invention helps resist any of the twisting, flexing or bending movements which so commonly occur with conventional golf club grips. The pistol grip body is used to add mass, stabilize the swing and reduce excess wrist movements by providing a firm grip handle which is contoured to fit the player's dominant hand in a fixed and consistent manner. The curved forearm stabilizer blade, which rests against and conforms to the shape of the inside of the player's dominant forearm, acts as a support for maintaining the desired pendulum motion, while resisting any flexing of the wrist when held firmly against the player's dominant forearm by the non-dominant hand.

The grip assembly described herein is particularly useful for putting clubs or putters. It is, however, also useful for short, medium and long range golf clubs of all head sizes and shapes.

While there has been described what is at present considered to be a preferred embodiment of this invention it will be obvious to those skilled in the art that various changes and modifications may be made therein without departing from the invention and it is, therefore intended to cover all such changes and modifications as come within the true spirit and scope of the invention.

What is claimed is:

1. A golf club grip assembly for stabilizing the swinging of a golf club, such assembly comprising:

a pistol grip body having a forward end adapted to be affixed to the upper end of a golf club shaft;

and a forearm stabilizer blade affixed directly to the rearward end of the pistol grip body and extending outwardly from such rearward end of the pistol grip body in a rearward direction for engaging the forearm of a golf player.

2. A golf club grip assembly in accordance with claim 1 wherein the forearm stabilizer blade has a curved cross-sectional shape corresponding to the curvature of the golf player's forearm.

3. A golf club grip assembly in accordance with claim 1 wherein the pistol grip body includes:

a thumb rest for the thumb of the dominant hand of a golf player;

an elongated index finger support for supporting the index finger of the dominant hand of the golf player in an extended position extending in the direction of the golf club shaft;

and a trigger-shaped middle finger support for gripping by the middle finger of the dominant hand of the golf player.

4. A golf club grip assembly in accordance with claim 3 wherein the forearm stabilizer blade has a length of at least five inches and a curved cross-sectional shape corresponding to the curvature of the golf player's forearm.

5. A golf club grip assembly for stabilizing the swinging of a golf club, such assembly comprising:

a pistol grip body adapted to be affixed to the upper end of a golf club shaft;

a forearm stabilizer member affixed to the pistol grip body and extending outwardly from a rearward end of the pistol grip body for engaging the forearm of a golf player;

and a connector rod extending from a forward end of the pistol grip body for insertion into the upper end of the golf club shaft.

6. A golf club grip assembly for stabilizing the swinging of a golf club, such assembly comprising:

an elongated body having a forward end adapted to be connected to the upper end of a golf club shaft, such elongated body having a thick rearward hand grip portion for gripping by the dominant hand of a golf player, a forward barrel-like portion, and a trigger-shaped portion located at the rearward end of the barrel-like portion on the underside thereof for gripping by the middle finger of the dominant hand of the golf player, the upper side juncture of the hand grip portion and the barrel-like portion being shaped to provide a thumb rest for the thumb of the dominant hand of the golf player;

and a singular forearm stabilizer blade affixed to the rearward end of the hand grip portion and extending outwardly in the rearward direction from such rearward end for engaging the dominant forearm of the golf player.

7. A golf club grip assembly in accordance with claim 6 and including a curved elongated index finger support member located on the side of the barrel-like portion and extending in the same direction as the barrel-like portion for supporting the index finger of the dominant hand of the golf player in an extended position extending in the direction of the barrel-like portion.

8. A golf club grip assembly in accordance with claim 7 and including a connector rod extending from the forward end of the barrel-like portion for insertion into the upper end of a golf club shaft.

9. A golf club grip assembly in accordance with claim 8 wherein the forearm stabilizer blade is an elongated blade having a length of at least five inches and a curved cross-sectional shape corresponding to the curvature of the golf player's forearm.

10. A golf club grip assembly in accordance with claim 6 wherein the forearm stabilizer blade is an elongated blade having a length of at least five inches and a curved cross-sectional shape corresponding to the curvature of the golf player's forearm.

11. A golf club grip assembly for stabilizing the swinging of a golf club, such assembly comprising:

an elongated body having a forward end adapted to be connected to the upper end of a golf club shaft, such elongated body having a thick rearward hand grip portion, a forward barrel-like portion, and a trigger-shaped portion located at the rearward end of the barrel-like portion on the underside thereof, the upper side juncture of the hand grip portion and the barrel-like portion being shaped to provide a thumb rest;

a forearm stabilizer member affixed to the elongated body and extending outwardly from the rearward end of the hand grip portion for engaging the forearm of a golf player;

and a connector rod extending from the forward end of the barrel-like portion for insertion into the upper end of a golf club shaft.

12. A golf club comprising:

a club head for striking a golf ball;

a golf club shaft affixed to the club head and extending upwardly therefrom;

a pistol grip body having a forward end affixed to the upper end of the golf club shaft for grasping by the dominant hand of a golf player;

and a forearm stabilizer blade mounted directly on the rearward end of the pistol grip body and extending upwardly from such rearward end of the pistol grip body for engaging the dominant forearm of the golf player.

13. A golf club in accordance with claim 12 wherein the pistol grip body includes:

a thumb rest for the thumb of the dominant hand of the golf player;

an elongated index finger support for supporting the index finger of the dominant hand of the golf player in an extended position extending in the direction of the golf club shaft;

and a trigger-shaped middle finger support for gripping by the middle finger of the dominant hand of the golf player.

14. A golf club in accordance with claim 12 wherein the forearm stabilizer blade is an elongated blade having a curved cross-sectional shape corresponding to the curvature of the golf player's dominant forearm.

15. A golf club comprising:

a club head for striking a golf ball;

a golf club shaft affixed to the club head and extending upwardly therefrom;

a pistol grip body having a forward end affixed to the upper end of the golf club shaft for grasping by the dominant hand of a golf player;

and a forearm stabilizer member affixed to the pistol grip body and extending upwardly from the rearward end of the pistol grip body for engaging the dominant forearm of the golf player;

the pistol grip body being affixed to the upper end of the golf club shaft by means of a connector rod which extends from the forward end of the pistol grip body and is inserted into the upper end of the golf club shaft.

16. A golf club in accordance with claim 15 wherein:

the pistol grip body includes a thumb rest, an elongated index finger support for supporting the golf player's index finger in an extended position extending in the direction of the golf club shaft, and a trigger-shaped middle finger support for gripping by the golf player's middle finger;

and the forearm stabilizer member is an elongated blade-like member having a curved cross-sectional shape corresponding to the curvature of the golf player's dominant forearm.

* * * * *